US005669283A

United States Patent [19]

Iida et al.

[11] Patent Number: 5,669,283

[45] Date of Patent: Sep. 23, 1997

[54] CYLINDER APPARATUS

[75] Inventors: Kenji Iida, Ibaraki-ken; Shuji Ono; Ken Kobayashi, both of Kadoma, all of Japan

[73] Assignees: SMC Kabushiki Kaisha, Tokyo; Matsushita Electric Industrial Co., Ltd., Kadoma, both of Japan

[21] Appl. No.: 582,911

[22] Filed: Jan. 4, 1996

[30] Foreign Application Priority Data

Jan. 17, 1995 [JP] Japan ..... 7-005254

[51] Int. Cl.[6] ..... F01B 15/02

[52] U.S. Cl. ..... 92/117 A; 92/5 R; 92/111; 92/85 R; 92/165 PR

[58] Field of Search ..... 92/117 R, 117 A, 92/165 R, 165 PR, 107, 108, 111, 85 R, 5 R

[56] References Cited

U.S. PATENT DOCUMENTS

| | | | |
|---|---|---|---|
| 2,255,395 | 9/1941 | Spink | 92/117 A |
| 3,653,302 | 4/1972 | Notenboom | 92/165 PR |
| 4,208,952 | 6/1980 | Ditlinger | 92/165 PR |
| 4,429,618 | 2/1984 | Klute et al. | 92/117 A |
| 4,442,694 | 4/1984 | Fusser et al. | 92/117 A |
| 4,872,360 | 10/1989 | Lew et al. | 92/117 A |
| 4,892,029 | 1/1990 | Walter | 92/117 A |
| 5,144,883 | 9/1992 | Muller et al. | 92/85 R |
| 5,299,489 | 4/1994 | Obrecht et al. | 92/5 R |

*Primary Examiner*—Thomas E. Denion

*Attorney, Agent, or Firm*—Oblon, Spivak, McClelland, Maier & Neustadt, P.C.

[57] ABSTRACT

A cylinder apparatus includes a base plate, a piston fixed to the base plate and having a piston head and a piston rod connected thereto, a cylinder body having a cylinder chamber defined on one side of the piston head and a cylinder chamber defined on another side of the piston head around the piston rod, the cylinder body being supported for reciprocating movement with respect to the base plate in axial directions of the piston, an upper plate fixed to the cylinder body, and a bushing held in slidable contact with an outer circumferential wall surface of the cylinder body for guiding the reciprocating movement of the cylinder body.

26 Claims, 12 Drawing Sheets

CYLINDER APPARATUS

BACKGROUND OF THE INVENTION

1. Field of the Invention

The present invention relates to a cylinder apparatus for use as a drive source or actuator for producing reciprocating movement in automatic machines in various factories, and more particularly to such a cylinder apparatus which is positioned between conveyor lines for displacing a workpiece a given distance.

2. Description of the Related Art

Workpiece feed systems that have heretofore been employed in factories are composed of a plurality of conveyors or feed rollers that are coupled together. One such feed system comprises a plurality of feed lines including first and second feed lines extending perpendicularly to each other and joined to each other at a junction where there is disposed a transfer unit for lifting a workpiece fed from the first feed line and transferring the lifted workpiece to the second feed line. The transfer unit may comprise, for example, a lifting device incorporating a cylinder.

One conventional lifting device incorporating a cylinder is shown in FIGS. 11 and 12 of the accompanying drawings. The lifting device, generally denoted by the reference numeral 2, includes a cylinder 6 fixedly mounted substantially centrally on a base plate 8 and having a piston rod 4 that is displaceable in the directions indicated by the arrows X ($X_1$, $X_2$). The lifting device 2 also has a pair of diagonally opposite guide rods 10*a*, 10*b* vertically movably disposed on the base plate 8. An upper plate 14 is coupled through an attachment plate 12 to respective upper ends of the piston rod 4 and the guide rods 10*a*, 10*b*. The cylinder 6 has a cylinder body 16 having a pair of compressed-air inlet/outlet ports 18*a*, 18*b* defined in a side wall thereof and connected to respective tubes 20. The tubes 20 have respective distal ends connected respectively to pipe joints 24*a*, 24*b* supported by a port block 22. A workpiece feed mechanism (not shown) such as a feed belt that is movable by a drive source is mounted on the upper plate 14.

The lifting device 2 operates as follows: The pipe joints 24*a*, 24*b* are connected to a compressed-air supply (not shown) through tubes (not shown). When the compressed-air supply is operated, it supplies compressed air to the cylinder 6 through the pipe Joints 24*a*, 24*b*, the tubes 20, and the compressed-air inlet/outlet ports 18*a*, 18*b*. When the compressed air is introduced into one cylinder chamber in the cylinder body 16, the piston is displaced, moving the piston rod 4 upwardly. The upper plate 14 coupled to the upper end of the piston rod 4 is guided by the guide rods 10*a*, 10*b* to move upwardly in the direction indicated by the arrow $X_1$. When the compressed air is introduced into the other cylinder chamber in the cylinder body 16, the upper plate 14 is lowered in the direction indicated by the arrow $X_2$.

With the lifting device 2 incorporated in the feed system described above, when a workpiece reaches a predetermined position upon being fed on the first feed line, the cylinder 6 is actuated to lift the upper plate 14, elevating the workpiece off the first feed line, and a feed belt located in a position higher than the first feed line is operated to hold the elevated workpiece and transfer the workpiece toward the second feed line. In this manner, the workpiece is transferred from the first feed line to the second feed line that extends perpendicularly to the first feed line.

The height of the conventional lifting device 2 is governed by the vertical dimension or height of the cylinder 6 that is disposed between the base plate 8 and the upper plate 14. Consequently, the height of the lifting device 2 cannot be made smaller than the height of the cylinder 6.

The conventional lifting device 2 is also disadvantageous in that because of plural parts including the cylinder 6, the guide rods 10*a*, 10*b*, the port block 22, etc. which are placed between the base plate 8 and the upper plate 14, the lifting device 2 is made up of many parts and assembled in many assembling steps, and as a result the cost of the lifting device 2 is relatively high.

SUMMARY OF THE INVENTION

It is a general object of the present invention to provide a cylinder apparatus which has a relatively low height or vertical dimension for space-saving purposes, and is made up of relatively few parts including unitized parts, so that the cylinder apparatus can be manufactured at a relatively low cost and in a relatively small number of assembling steps.

A major object of the present invention is to provide a cylinder apparatus which is designed for effective utilization of a vertical space in a workpiece feed system to allow the workpiece feed system to be arranged in a relatively large choice available of layout options.

Another object of the present invention is to provide a cylinder apparatus which can easily be inspected and serviced for maintenance and permits easy replacement of parts.

The above and other objects, features, and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

Figure 1:
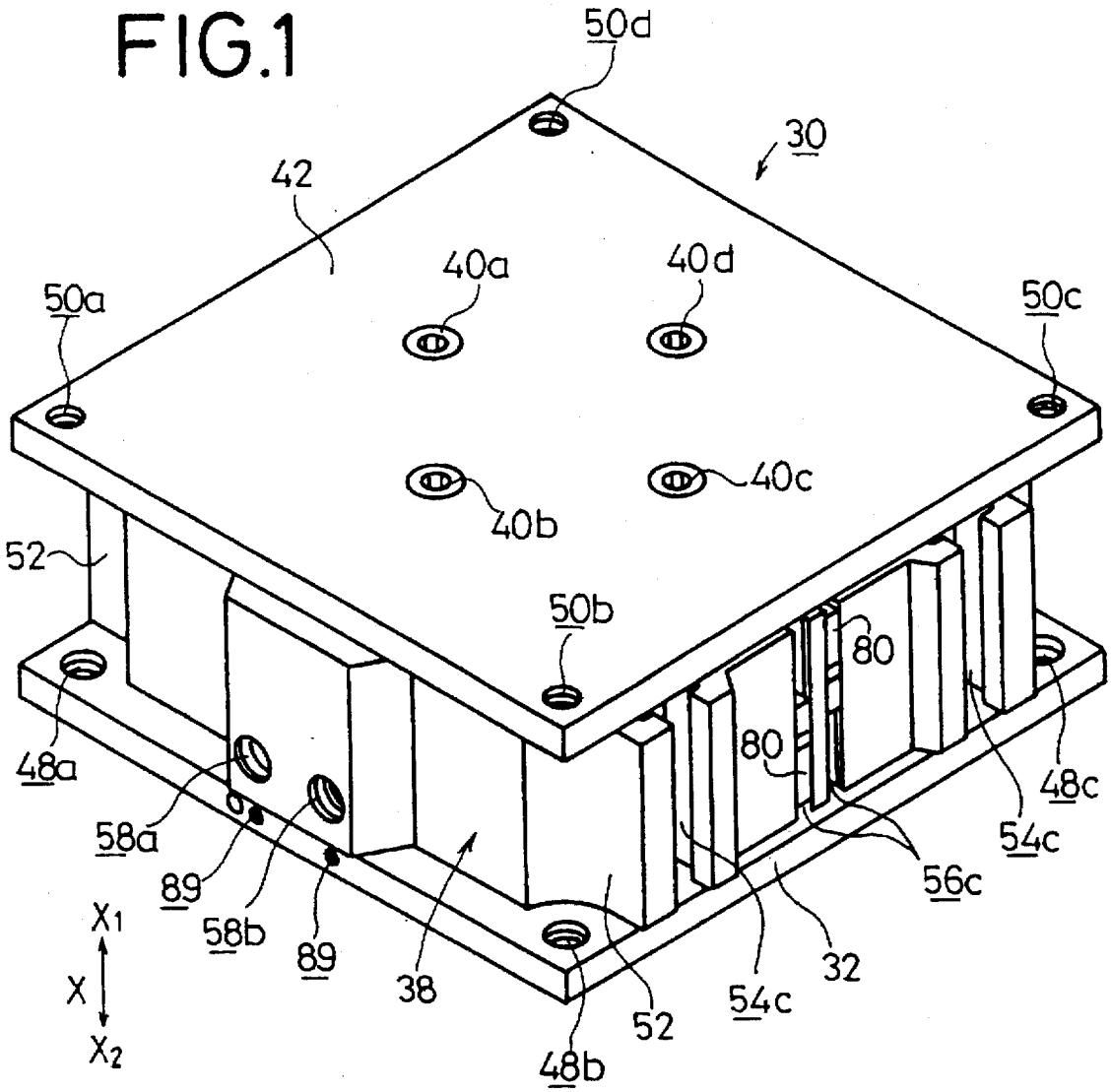
FIG. 1 is a perspective view of a cylinder apparatus according to a first embodiment of the present invention.

As shown in FIG. 1, a cylinder apparatus 30 according to a first embodiment of the present invention basically comprises a horizontal, substantially square base plate 32, a casing 38 fastened to a stepped portion on the base plate 32 by screws 33 (see FIG. 3) and having a cylinder body 36 vertically movably disposed in a through hole 34 (see FIGS. 4 and 5) of substantially circular cross section which is defined in the casing 38, and an upper plate 42 having substantially the same shape as the base plate 32 and fixed to the cylinder body 36 by screws 40*a*~40*d*. An annular seal 46 (see FIGS. 4 and 5) is interposed between the upper plate 42 and the cylinder body 36 for keeping cylinder chambers 44*a*, 44*b* (described later on) hermetically sealed.

The base plate 32 and the upper plate 42 have respective sets of internally threaded attachment holes 48*a*~48*d* and 50*a*~50*d* defined therein at respective four corners thereof. The cylinder apparatus 30 may be secured to another member by screws (not shown) that are threaded into the internally threaded attachment holes 48*a*~48*d* in the base plate 32, for example. Alternatively, the cylinder apparatus 30 may be secured to another member by screws (not shown) that are threaded into the internally threaded attachment holes 50*a*~50*d* in the upper plate 42. The casing 38 has concave surfaces 52 defined in respective outer surfaces of the four corners thereof closely to, but clear of, the respective attachment holes 48*a*~48*d* for thereby exposing the attachment holes 48*a*~48*d*.

The casing 38 also has three pairs of spaced attachment grooves 54*a*~54*c* (see FIG. 3) of substantially T-shaped cross section which are defined respectively in three outer wall surface thereof, the attachment grooves 54*a*~54*c* extending vertically in the directions indicated by the arrows X ($X_1$, $X_2$). The casing 38 further has three pairs of sensor attachment grooves 56*a*~56*c* defined respectively in three outer wall surfaces thereof between the three pairs of spaced attachment grooves 54*a*~54*c*, the sensor attachment grooves 56*a*~56*c* extending vertically in the directions indicated by the arrows X ($X_1$, $X_2$). The cylinder apparatus 30 can be supported laterally on another member by retainers (not shown) with enlarged heads, which are complementary in cross-sectional shape to the attachment grooves 54*a*~54*c* and fitted respectively in the attachment grooves 54*a*~54*c*. Since the attachment grooves 54*a*~54*c* extend vertically in the directions indicated by the arrows X ($X_1$, $X_2$), the vertical position or height of the retainers can be adjusted with respect to the casing 38.

Figure 3:
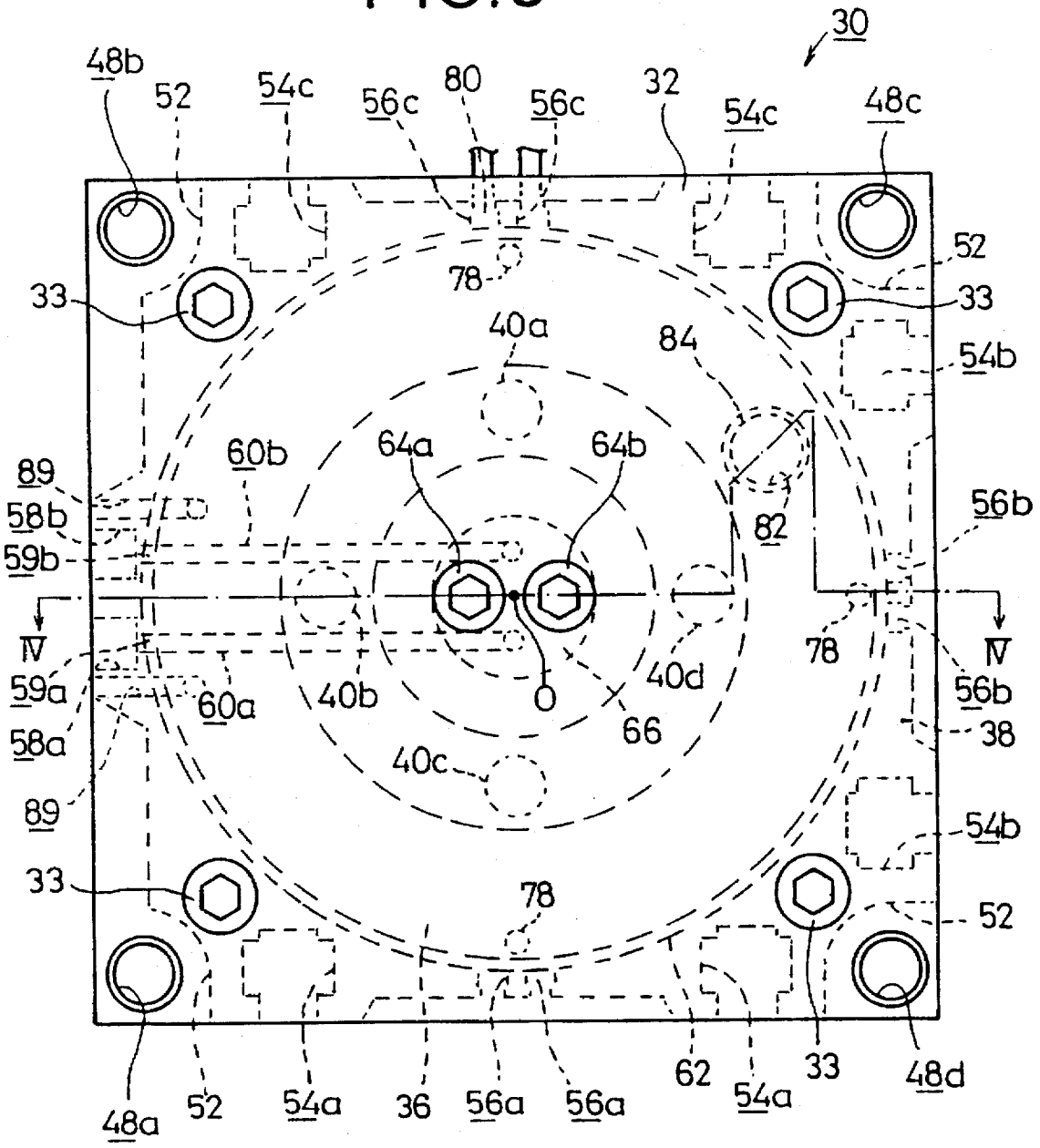
FIG. 3 is a bottom view of the cylinder apparatus shown in FIG. 1.
Figure 4:
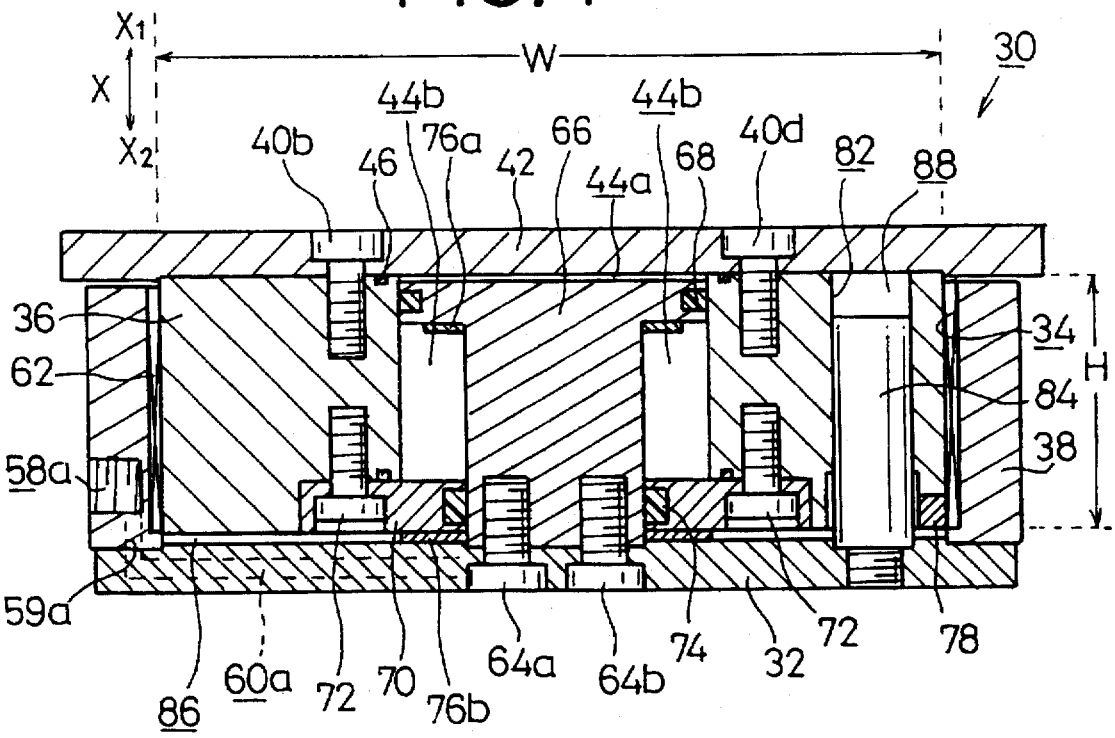
FIG. 4 is a vertical cross-sectional view taken along line IV—IV of FIG. 3.
Figure 5:
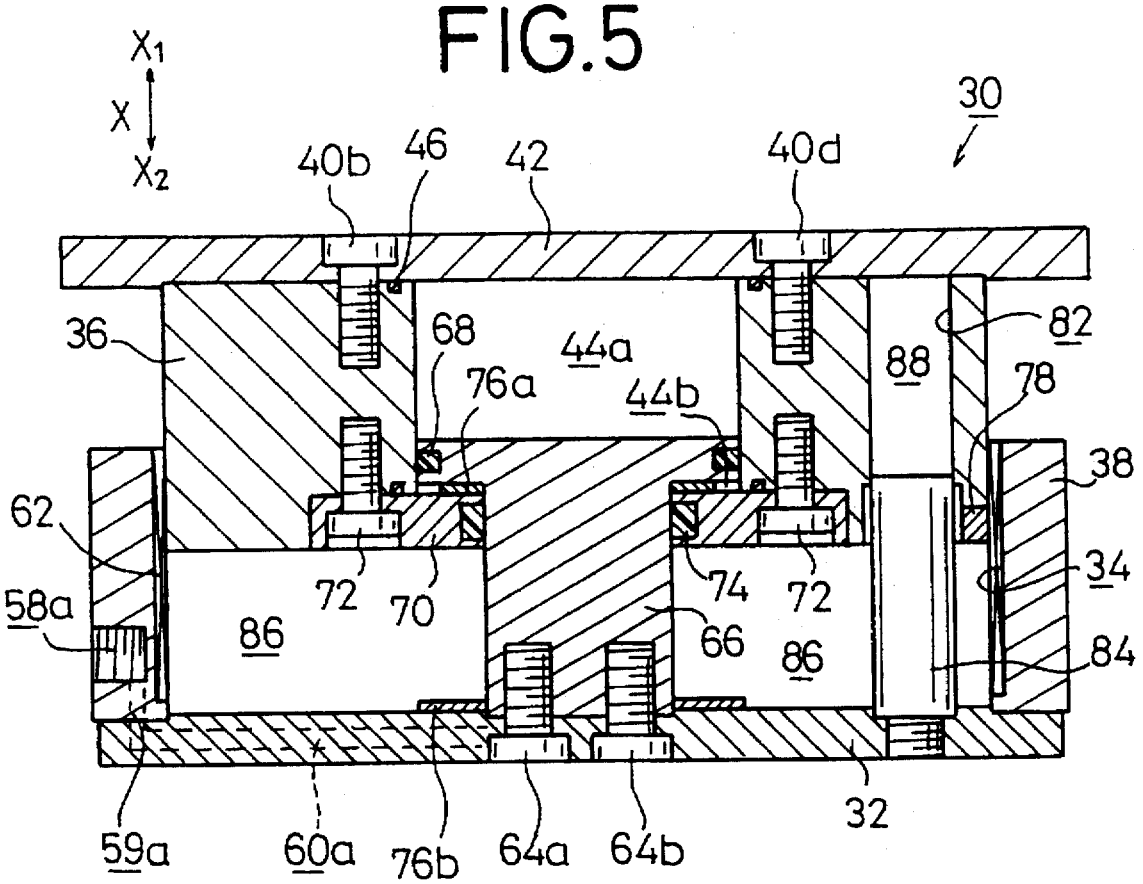
FIG. 5 is a vertical cross-sectional view of the cylinder apparatus shown in FIG. 4, with the upper plate lifted.
Figure 6:
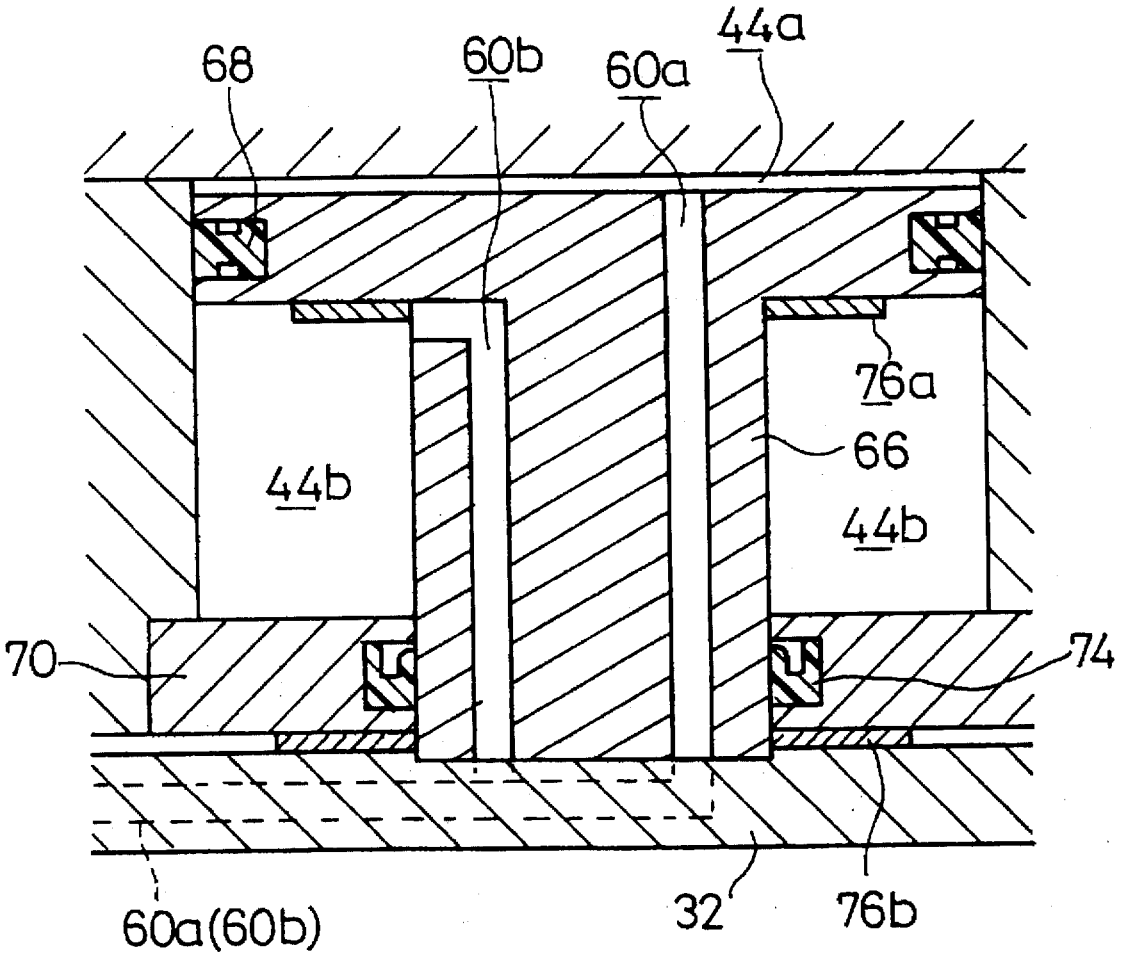
FIG. 6 is an enlarged fragmentary cross-sectional view showing communication passages communicating with cylinder chambers.

The remaining outer wall surface of the casing 38, which is devoid of any attachment grooves and sensor attachment grooves, has a pair of compressed-air inlet/outlet ports 58*a*, 58*b* defined therein which communicate through respective ports 59*a*, 59*b* (see FIG. 3) defined in a lower portion of the outer wall surface of the casing 38 and also through communication passages 60*a*, 60*b* defined in the base plate 32 and the piston 66 with respective cylinder chambers 44*a*, 44*b* (see FIG. 6). As shown in FIGS. 3, 4, and 5, a cylindrical bushing (guide member) 62 made of synthetic resin or the like is coaxially fitted in the through hole 34 of substantially circular cross section which is defined in the casing 38. The cylindrical bushing 62 is interposed radially between the inner wall surface of the casing 38 and the outer wall surface of the cylinder body 36. The cylinder body 36 is axially movable along the inner wall surface of the cylindrical bushing 62.

A piston 66 (see FIGS. 4 and 5) is fixed substantially centrally to the base plate 32 by a pair of screws 64*a*, 64*b* threaded through the base plate 32 into a lower end of the piston 66. The piston 66 is positioned centrally in the casing 38 and housed in a large-diameter hole defined in the cylinder body 36 and extending axially in the directions indicated by the arrows X ($X_1$, $X_2$), with a seal ring 68 disposed around a larger-diameter flange, serving as a piston head, of the piston 66 at its upper end and slidably held against the inner wall surface of the large-diameter hole. The piston 66 divides the large-diameter hole in the cylinder body 36 into an upper cylinder chamber 44*a* defined axially between the larger-diameter flange of the piston 66 and the upper plate 42 and a lower cylinder chamber 44*b* defined radially around a smaller-diameter portion, serving as a piston rod, of the piston 66 axially between the larger-diameter flange of the piston 66 and an annular rod cover 70 attached to a lower end of the cylinder body 36.

The cylinder body 36 has an annular step defined in the lower end thereof, and the annular rod cover 70 is fastened to the annular step by screws 72 in surrounding relationship to the piston 66 with an annular seal 74 retained by the annular rod cover 70 in slidable contact with the outer circumferential surface of the piston 66. As shown in FIG. 4, the cylinder body 36 has a diameter W greater than its height or axial dimension H.

When a fluid under pressure is introduced through the communication passage 60*a* into the upper cylinder chamber 44*a*, the cylinder body 36 is lifted along the inner wall surface of the bushing 62 in the direction indicated by the arrow $X_1$, as shown in FIG. 5. When a fluid under pressure is introduced through the communication passage 60*b* into the lower cylinder chamber 44*b*, the cylinder body 36 is lowered along the inner wall surface of the bushing 62 in the direction indicated by the arrow $X_2$, as shown in FIG. 4.

An annular damper (cushioning member) 76*a* is mounted on the lower surface of the larger-diameter flange of the piston 66, and an annular damper (cushioning member) 76*b* is mounted on the upper surface of the base plate 32 around the piston 66. The annular damper 76*a* abuts against the upper surface of the rod cover 70 when the cylinder body 36 reaches an upper end of its vertical stroke upon upward movement thereof. The annular damper 76*b* abuts against the lower surface of the rod cover 70 when the cylinder body 36 reaches a lower end of its vertical stroke upon downward movement thereof. Therefore, the annular dampers 76*a*, 76*b* serve to dampen shocks and minimize noise when the cylinder body 36 reaches the ends of its vertical stroke. When the rod cover 70 abuts against the larger-diameter flange of the piston 66 at its upper end, the rod cover 70 serves as a stop at the upper end of the vertical stroke of the cylinder body 36 upon upward movement.

As can be seen from FIG. 3, the piston 66, the rod cover 70, the Cylinder body 36, and the cylindrical bushing 62 are coaxial with each other with respect to a point O where the diagonal lines of the substantially square base plate 32 cross each other.

As shown in FIGS. 3, 4, and 5, magnets 78 are supported on the cylinder body 36 at its lower end in the vicinity of the respective pairs of sensor attachment Grooves 56*a*~56*c* defined in the casing. Sensors 80 (see FIGS. 1 and 2) held in position in the sensor attachment grooves 56*c* detect magnetic fluxes from the corresponding magnet 78 for detecting the vertical position of the cylinder body 36 with respect to the casing 38.

As shown in FIGS. 3 and 4, an axial guide hole 82 is defined in the cylinder body 36 at a position spaced a given distance radially outwardly from the point O, and a guide rod 84 fixed to the base plate 32 is inserted in the guide hole 82. The guide rod 84 inserted in the guide hole 82 to lock the cylinder body 36 against angular displacement with respect to the base plate 32 and hence the casing 38 and also to guide the cylinder body 36 for its vertical movement with respect to the base plate 82 and hence the casing 38. The guide rod 84 may, however, be dispensed with if the outer wall surface of the cylinder body 36 and the inner wall surface of the casing 38 are complementarily angularly shaped.

Figure 2:
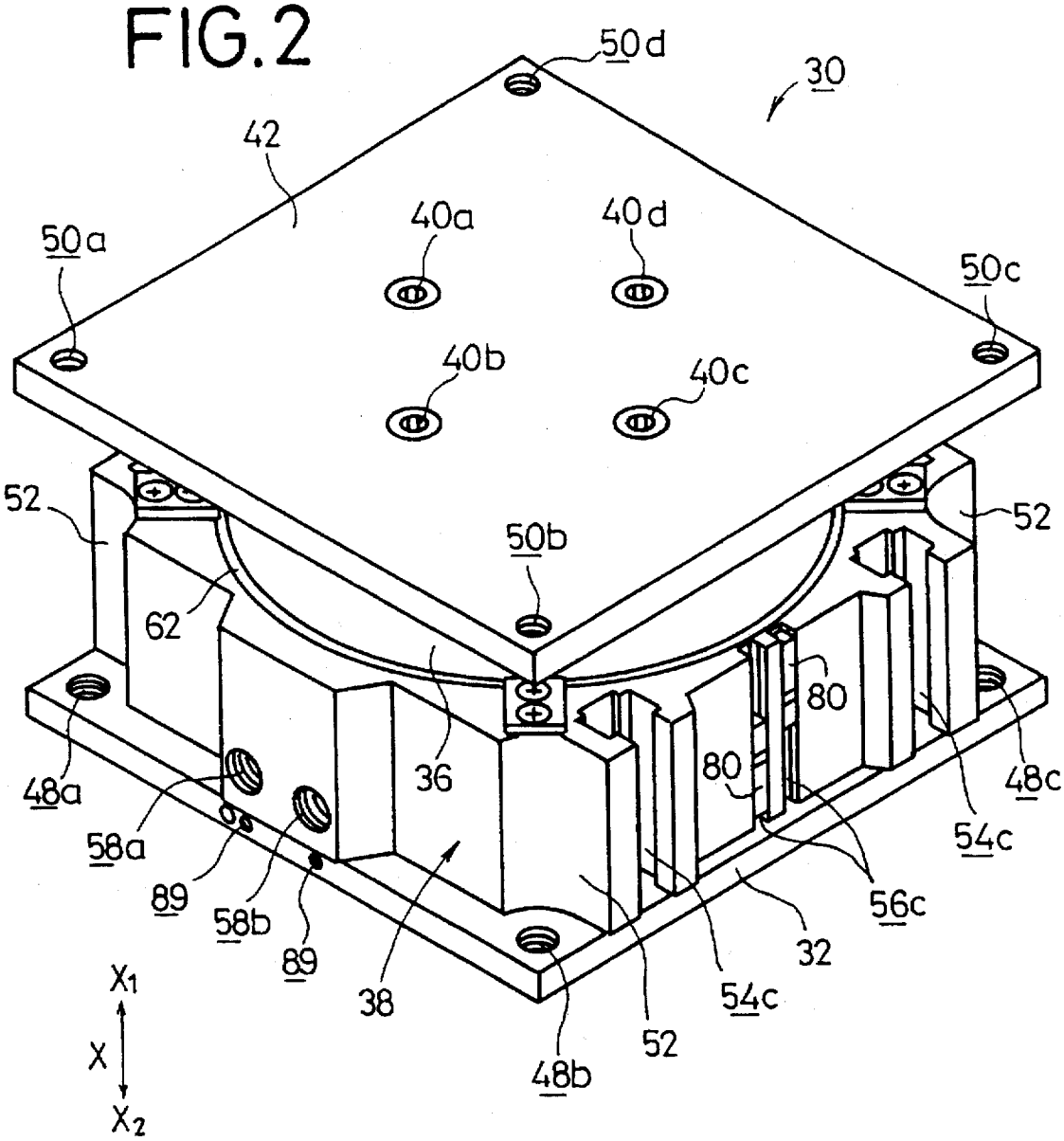
FIG. 2 is a perspective view of the cylinder apparatus shown in FIG. 1, with an upper plate lifted.

As shown in FIGS. 1, 2, and 3, air inlet/outlet holes 89 are defined in the base plate 32 and communicate through passages (not shown) with respective chambers 86, 88 defined between the base plate 32 and the cylinder body 36 and between the upper plate 42 and the guide rod 84. When the cylinder body 36 is lifted or lowered, air is introduced into or discharged from the chambers 86, 88 through the air inlet/outlet holes 89.

Operation of the cylinder apparatus 30 according to the first embodiment of the present invention will be described below.

Figure 7A:
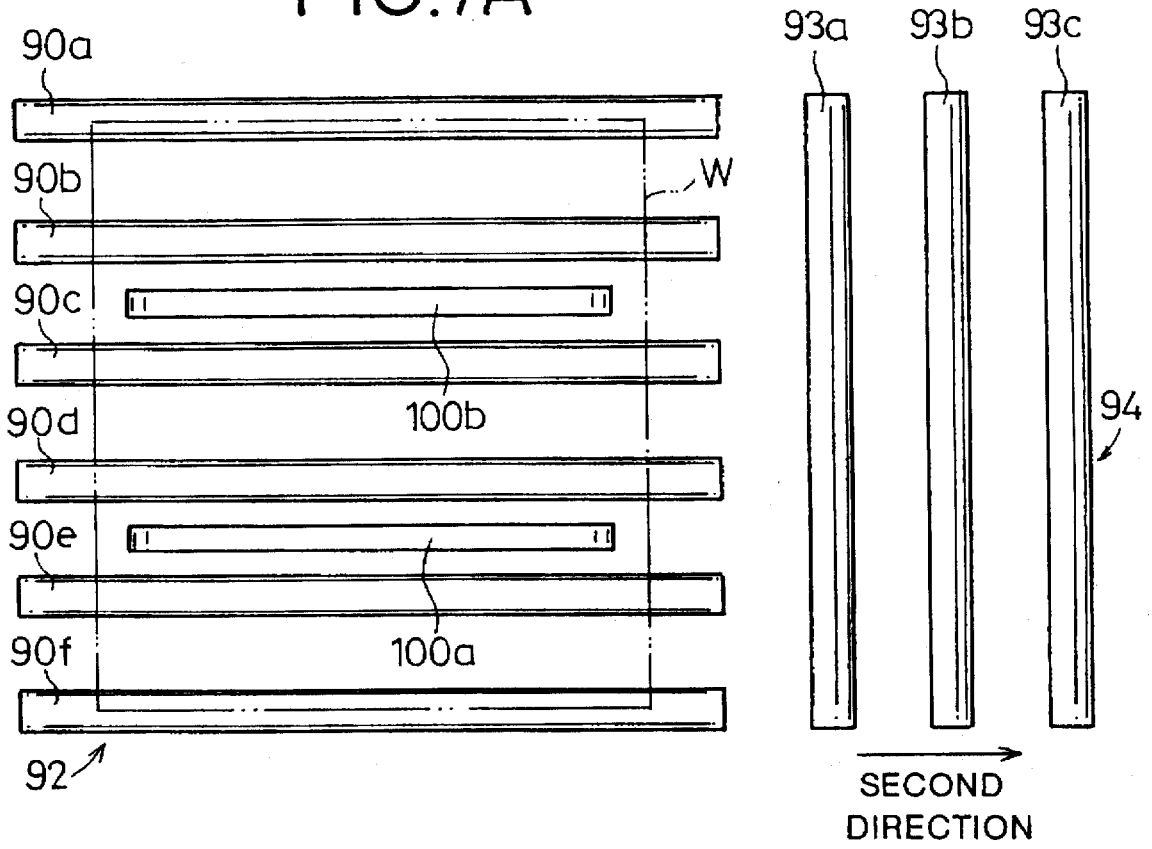
FIG. 7A is a plan view of a workpiece feed system with the cylinder apparatus shown in FIG. 1 being disposed at a junction between first and second feed lines.
Figure 7B:
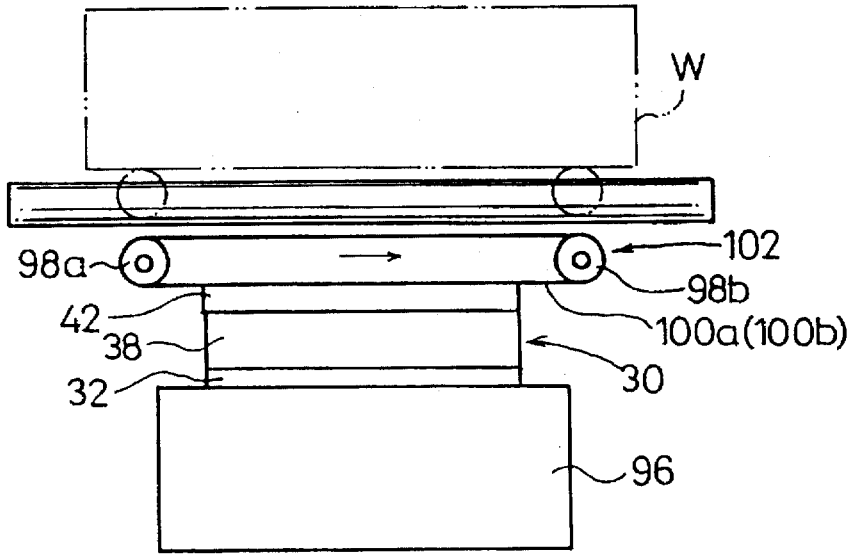
FIG. 7B is a front elevational view of the workpiece feed system shown in FIG. 7A.

As shown in FIG. 7A, a workpiece feed system has a first feed line 92 and a second feed line 94. The first feed line 92 comprises a plurality of feed rollers 90*a*~90*f* which are arranged substantially parallel to each other and which can be rotated by a drive source (not shown) for feeding a workpiece W in a first direction along the first feed line 92. The second feed line 94 comprises a plurality of feed rollers 93*a*~93*c* which are arranged substantially parallel to each other and which can be rotated by a drive source (not shown) for feeding a workpiece W in a second direction along the second feed line 92, which is substantially perpendicular to the first direction. The cylinder apparatus 30 is fixedly mounted on a base 96 (see FIG. 7B) by screws which are threaded through the attachment holes 48*a*~48*d* into the base 96. The cylinder apparatus 30 supports, on the upper plate 42, a feed unit 102 which comprises a pair of substantially parallel, spaced conveyor belts 100*a*, 100*b* that are trained around guide rollers 98*a*, 98*b* and can be moved in the direction indicated by the arrow by a drive source (not shown). The conveyor belts 100*a*, 100*b* extend parallel to the feed rollers 93*a*~93*c* and are positioned between the adjacent feed rollers 90*b*, 90*c* and between the feed rollers 90*d*, 90*e*, respectively. The compressed-air inlet/outlet ports 58*a*, 58*b* of the cylinder apparatus 30 are connected to a compressed-air supply (not shown) through tubes (not shown).

A process of transferring the workpiece W from the first feed line 92 onto the second feed line 94 in the direction indicated by the arrow in FIG. 7A will be described below.

When the workpiece W reaches a given position on the conveyor belts 100*a*, 100*b*, a detector (not shown) detects the workpiece W and outputs a detected signal to operate a directional control valve (not shown) for thereby supplying compressed air to the compressed-air inlet/outlet port 58*a* of the cylinder apparatus 30. The supplied compressed air lifts the upper plate 42 of the cylinder apparatus 30. The lifted upper plate 42 elevates the workpiece on the feed unit 102 off the feed rollers 90*a*~90*f*. When the feed unit 102 projects upwardly beyond the feed rollers 90*a*~90*f*, the conveyor belts 100*a*, 100*b* are operated to transfer the workpiece W from the first feed line 92 onto the second feed line 94 that extends substantially perpendicularly to the first feed line 92.

More specifically, the compressed air supplied to the compressed air inlet/outlet port 58*a* is introduced through the communication passage 60*a* in the base plate 32 into the upper cylinder chamber 44*a*, lifting the upper plate 42 in the direction indicated by the arrow $X_1$. At this time, the other compressed-air inlet/outlet port 58*b* is vented to the atmosphere. The upper plate 42 ascends in unison with the cylinder body 36 in the direction indicated by the arrow $X_1$ while being guided by the guide rod 84 until the upper plate 42 reaches the upper end of its stroke shown in FIG. 5. When the upper plate 42 reaches the upper end of its stroke shown in FIG. 5, the rod cover 70 abuts against the damper 76*a*, which absorbs shocks and minimizes noise. Upon upward movement in the direction indicated by the arrow $X_1$, the conveyor belts 100*a*, 100*b* project upwardly through gaps between the adjacent feed rollers 90*b*, 90*c* and between the feed rollers 90*d*, 90*e*, respectively, as indicated by the two-dot-and-dash lines in FIG. 7B, supporting the workpiece W a given distance off the feed rollers 90*a*~90*f*. Then, the conveyor belts 100*a*, 100*b* are operated to transfer the workpiece W onto the second feed line 94 perpendicular to the first feed line 92. Thereafter, the workpiece W is fed to a desired position by the second feed line 94.

After the workpiece W has been transferred to the second feed line 94, compressed air is supplied to the compressed-air inlet/outlet port 58*b* while the compressed-air inlet/outlet port 58*a* is being vented to the atmosphere. The upper plate 42 is now displaced in unison with the cylinder body 36 downwardly in the direction indicated by the arrow $X_2$ until it reaches the lower end of its stroke shown in FIG. 4.

As described above, the diameter W of the cylinder body 36 which supports the upper plate 42 and displaces the upper plate 42 in the direction indicated by the arrow $X_1$ or $X_2$ is greater than the height H of the cylinder body 36 (see FIG. 4). The cylinder body 36 is vertically movably held in the casing which surrounds the cylinder body 36. The cylinder body 36 and the upper plate 42 can be lifted and lowered with respect to the piston 66 fixed to the base plate 32 while at the same time the cylinder body 36 is being guided by the cylindrical bushing 62.

If a workpiece feed system comprises a pair of upper and lower first feed lines 92 and a pair of upper and lower second feed lines 94 perpendicular to the first feed lines 92, then two upper and lower cylinder apparatus 30 may be positioned at a junction between the first and second feed lines 92, 94 because the height H of each of the cylinder apparatus 30 is relatively small with respect to the diameter W of the cylinder body 36. Consequently, the vertical space in the workpiece feed system is effectively utilized to allow itself to be arranged in a relatively large choice available of layout options.

The cylinder body 36, the piston 66, the rod cover 70, and other parts can be detached when the screws 33, 64*a*, 64*b* are removed from the base plate 32 and the screws 40*a*~40*d* are removed from the upper plate 42. Accordingly, the cylinder body 36, the piston 66, the rod cover 70, and other parts can easily be inspected and serviced for maintenance, and can also easily be replaced with new parts.

Figure 11:
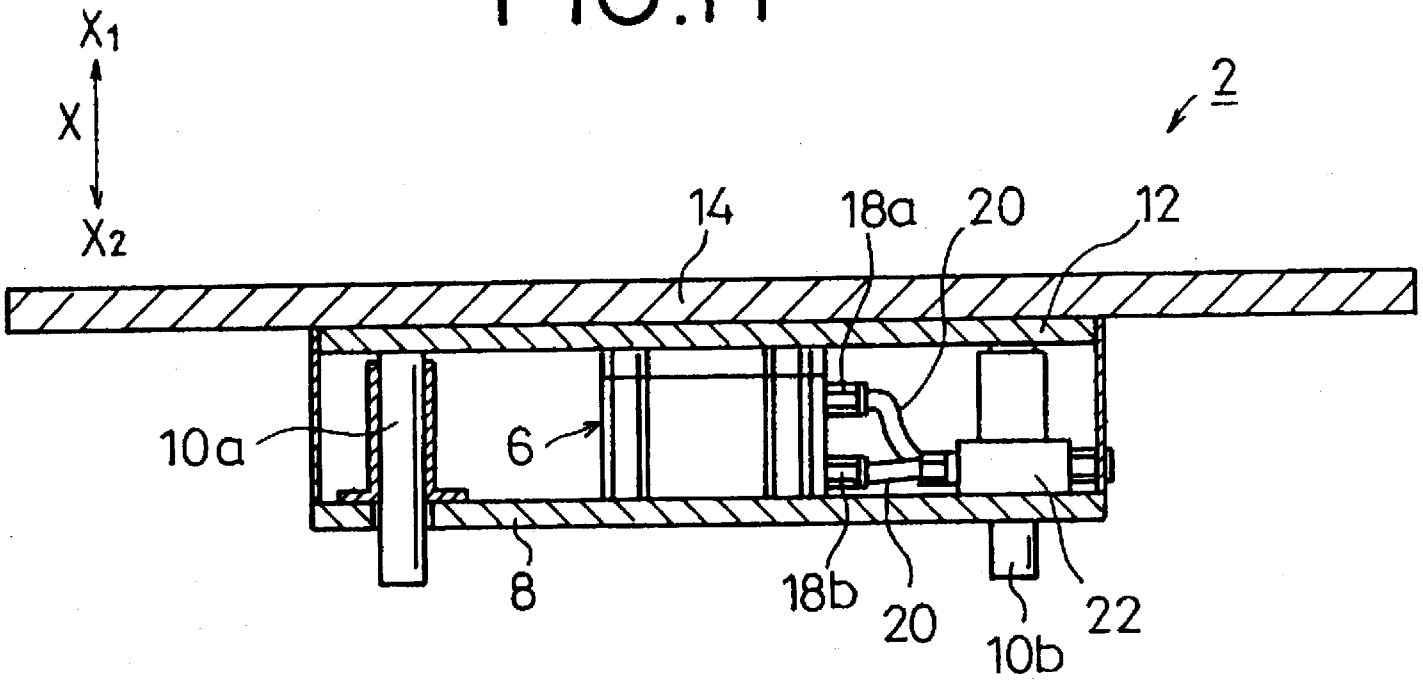
FIG. 11 is a vertical cross-sectional view of a conventional lifting device.
Figure 12:
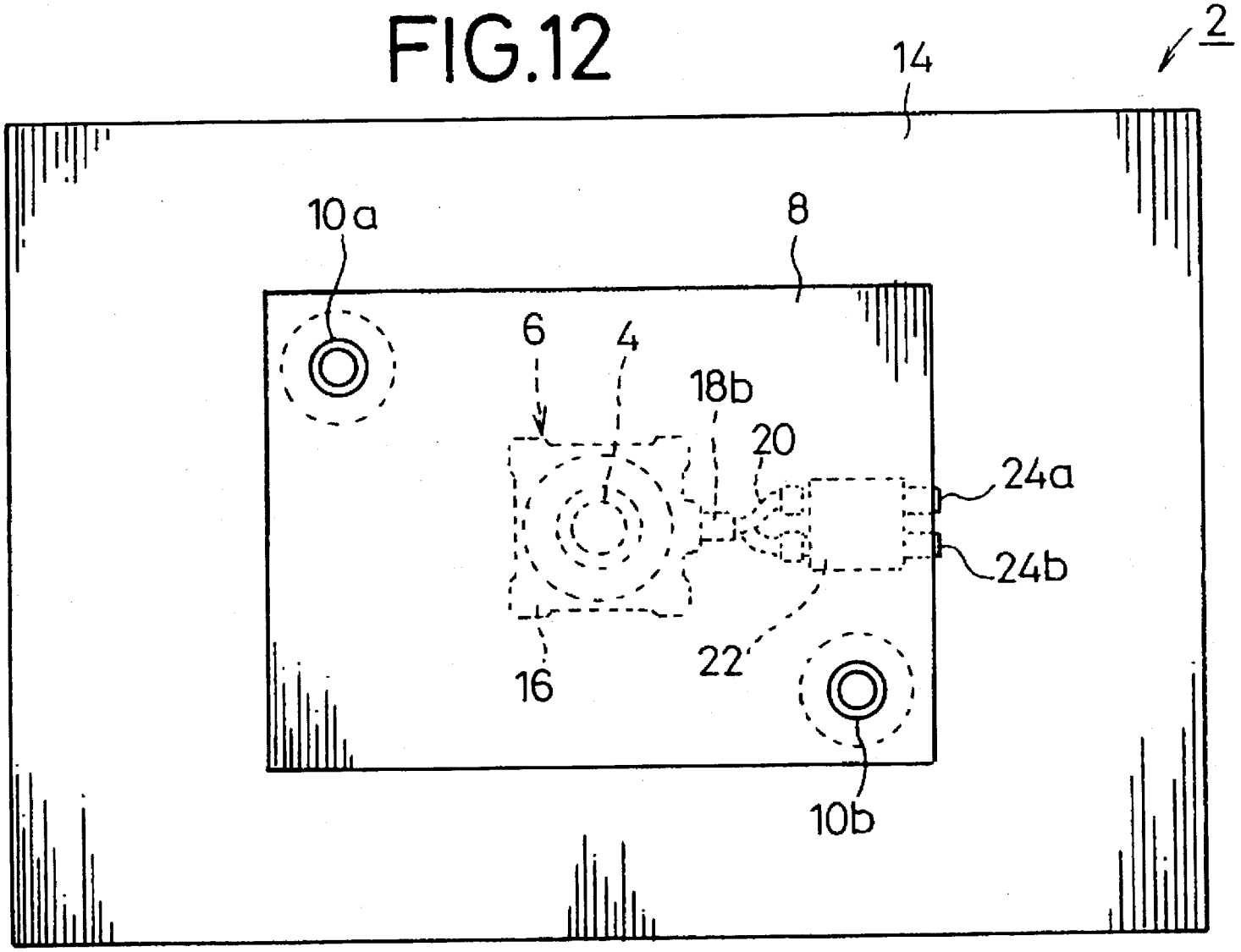
FIG. 12 is a bottom view of the lifting device shown in FIG. 11.

Since some of the parts of the cylinder apparatus 30 are fastened and hence unitized by the screws, the cylinder apparatus 10 is made up of relatively few parts including those unitized parts, so that the cylinder apparatus 30 can be manufactured at a relatively low cost in a relatively small number of assembling steps as compared with the conventional lifting devices shown in FIGS. 11 and 12.

Figure 8:
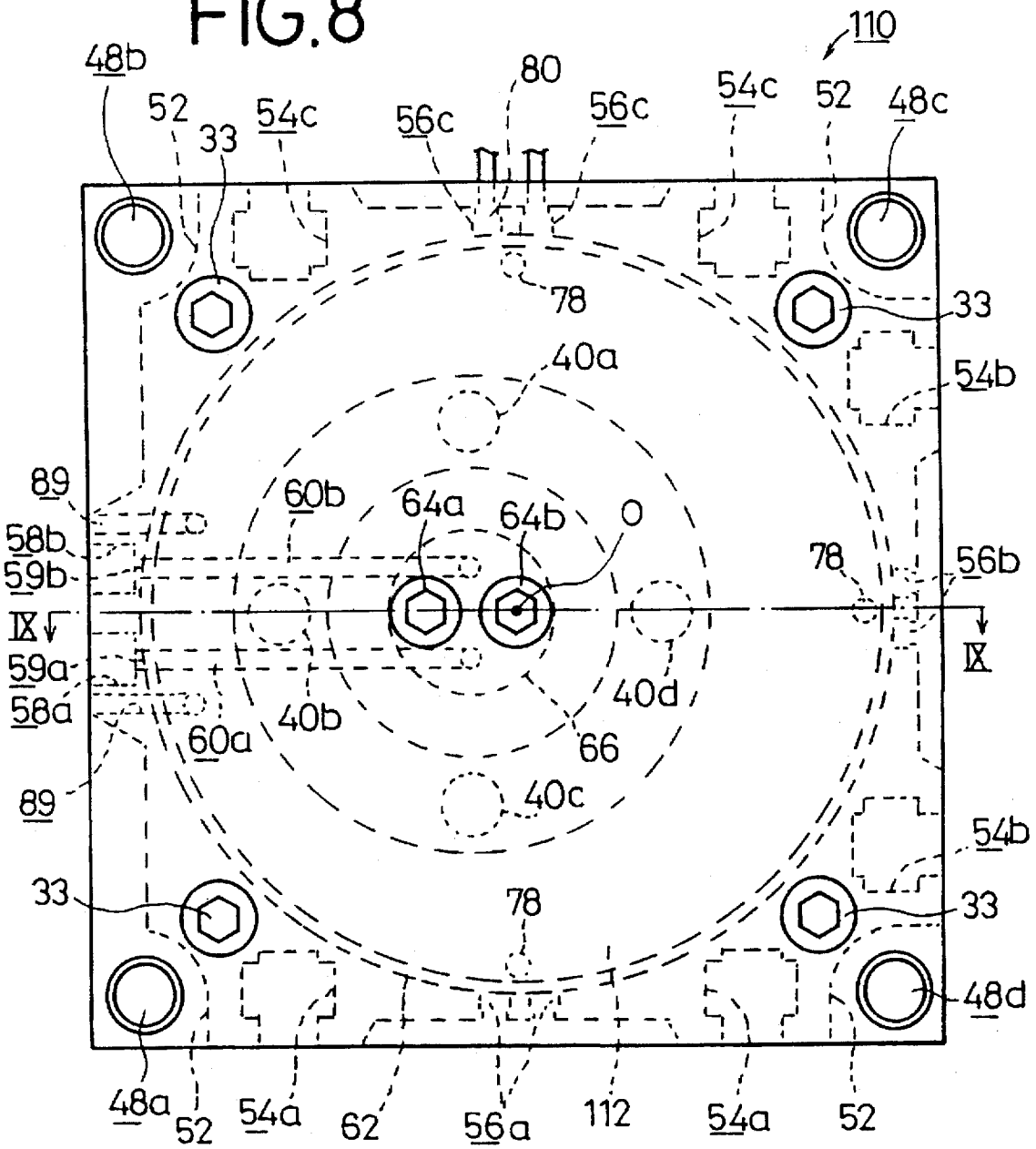
FIG. 8 is a bottom view of a cylinder apparatus according to a second embodiment of the present invention.
Figure 9:
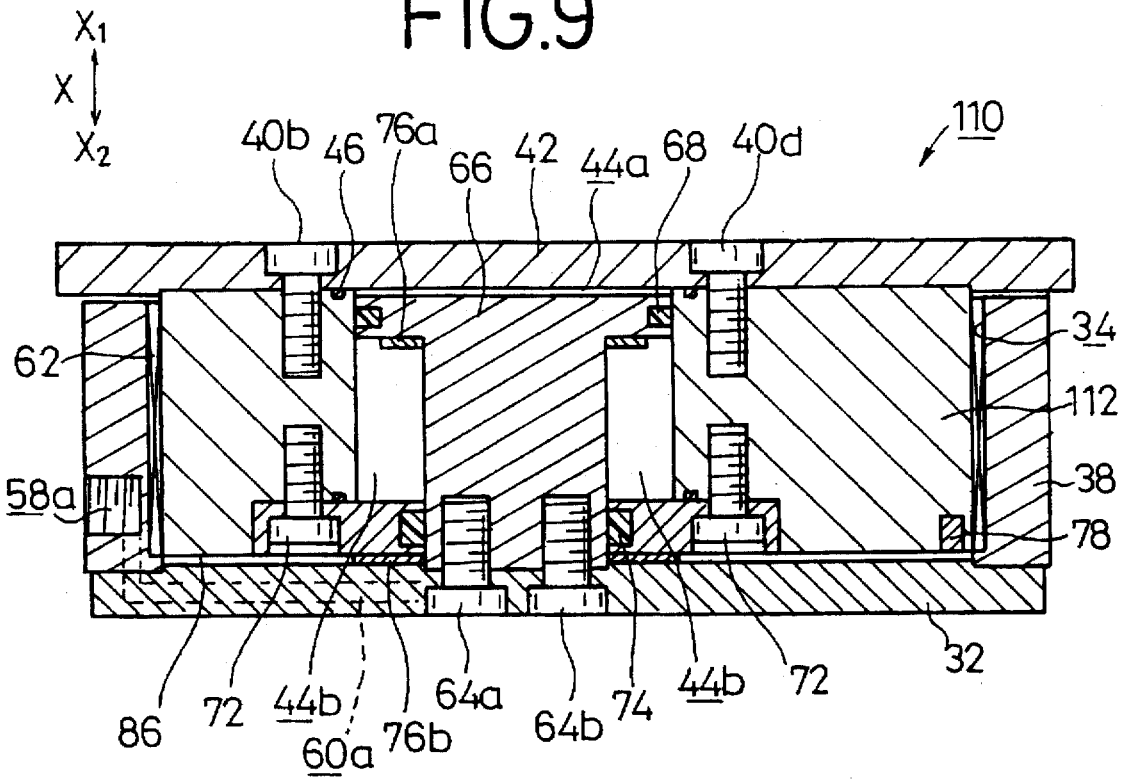
FIG. 9 is a vertical cross-sectional view taken along line IX—IX of FIG. 8.
Figure 10:
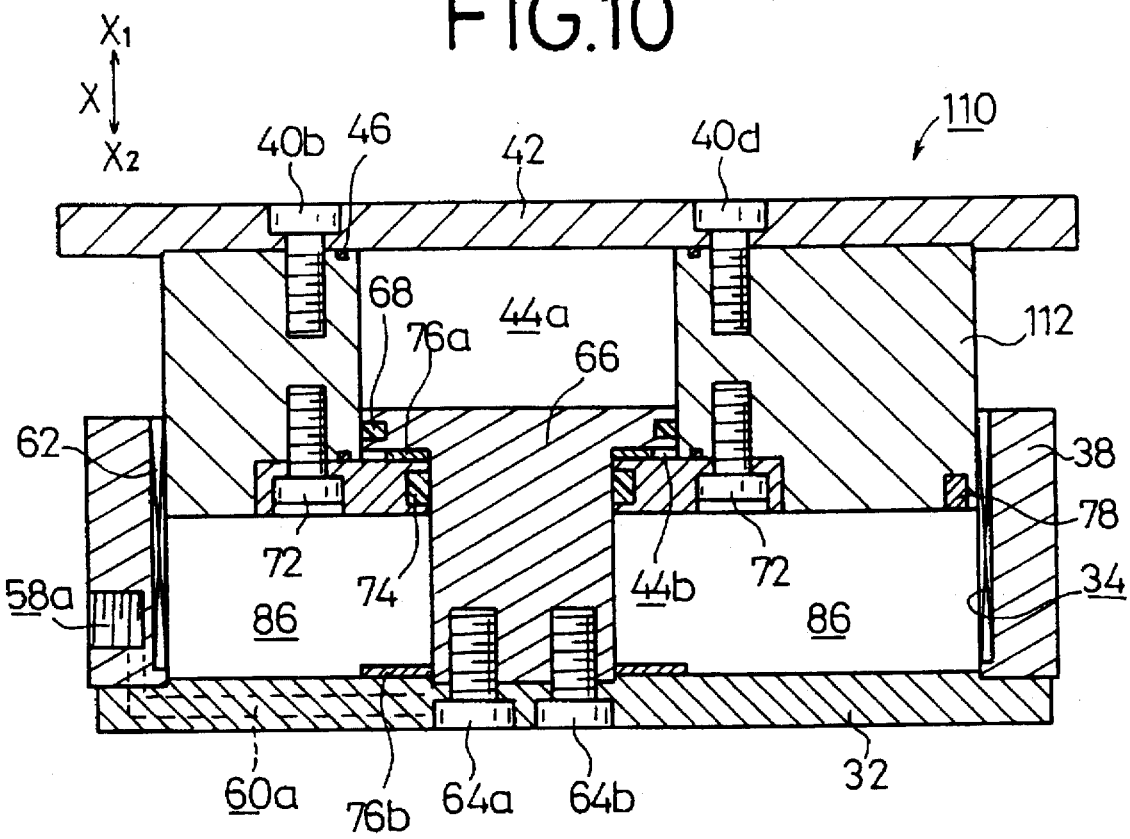
FIG. 10 is a vertical cross-sectional view of the cylinder apparatus shown in FIG. 9, with the upper plate lifted.

A cylinder apparatus according to a second embodiment of the present invention is illustrated in FIGS. 8 through 10. Only those parts of the cylinder apparatus, generally denoted by the reference numeral 110, which are different from those of the cylinder apparatus 30 according to the first embodiment will be described below. Those parts shown in FIGS. 8 through 10 which are identical to those shown in FIGS. 1 through 7A, 7B are denoted by identical reference numerals, and will not be described in detail below.

As shown in FIGS. 8 through 10, the cylinder apparatus 110 differs from the cylinder apparatus 30 according to the first embodiment in that the center of a piston 66 is displaced off the point O where the diagonal lines of a substantially square base plate 32 cross each other, and that the cylinder apparatus 110 does not have a guide rod, equivalent to the guide rod 84 in the first embodiment, for locking a cylinder body 112 against angular displacement with respect to the base plate 32. The cylinder apparatus 110 is therefore made up of fewer parts and can be manufactured less costly than the cylinder apparatus 30 according to the first embodiment. Otherwise, the cylinder apparatus 110 operates in the same manner and offers the same advantages as the cylinder apparatus 30 according to the first embodiment.

In the first and second embodiments, the cylinder body 36, 112 is vertically displaceable with respect to the piston 66 fixed to the base plate 32 which extends horizontally. However, the base plate 32 may be arranged vertically, and the cylinder body 36, 112 may be arranged so as to be displaceable horizontally with respect to the horizontal piston 66 fixed to the vertical base plate 32.

Although certain preferred embodiments of the present invention have been shown and described in detail, it should be understood that various changes and modifications may be made therein without departing from the scope of the appended claims.

What is claimed is:

1. A cylinder apparatus comprising:

a base plate;

a piston fixed on top of said base plate and having a piston head and a piston rod connected thereto, wherein an end of said piston rod opposite said piston head is disposed on an upper surface of said base plate;

a cylinder body having a cylinder chamber defined on one side of said piston head and a cylinder chamber defined on another side of the piston head around said piston rod, said cylinder body being supported for reciprocating movement with respect to said base plate in axial directions of said piston, said cylinder body having a diameter greater than an axial dimension thereof which is perpendicular to said diameter;

a guide rod fixed to said base plate and inserted in said cylinder body for guiding the reciprocating movement of said cylinder body;

an upper plate fixed on top of said cylinder body;

a guide member comprising a casing surrounding said cylinder body and held in slidable contact with an outer circumferential wall surface of said cylinder body for guiding the reciprocating movement of the cylinder body;

a pair of compressed-air inlet/outlet ports defined in a side wall of said casing for introducing a fluid under pressure alternately to said cylinder chambers;

a first pair of communication passages defined in said base plate; and a second pair of communication passages defined in said piston and connected with said first pair of communication passages, wherein said compressed-air inlet/outlet ports communicate with said cylinder chambers through said first and second pairs of communication passages.

2. A cylinder apparatus according to claim 1, wherein said guide member comprises said casing surrounding said cylinder body and a bushing interposed between said casing and said cylinder body and held in slidable contact with the outer circumferential wall surface of said cylinder body.

3. A cylinder apparatus according to claim 1, further comprising locking means for locking said cylinder body against angular displacement with respect to said base plate upon the reciprocating movement of the cylinder body in the axial directions of said piston.

4. A cylinder apparatus according to claim 3, wherein said locking means comprises said guide rod fixed to said base plate, and a hole defined in said cylinder body, said guide rod being inserted in said hole.

5. A cylinder apparatus according to claim 1, wherein said piston is fixed to said base plate at a off-center position with respect to said cylinder body.

6. A cylinder apparatus according to claim 1, further comprising a cushioning member mounted on a surface of said piston for abutment against said cylinder body.

7. A cylinder apparatus according to claim 1, further comprising a cushioning member mounted on a surface of said cylinder body for abutment against said base plate or a surface of said base plate for abutment against said cylinder body.

8. A cylinder apparatus according to claim 6 or 7, wherein said cushioning member comprises an annular damper.

9. A cylinder apparatus according to claim 1, further comprising a magnet disposed on or near the outer circumferential wall surface of said cylinder body.

10. A cylinder apparatus according to claim 9, wherein said casing has a plurality of sensor attachment grooves defined in at least one outer wall surface thereof, and a sensor mounted in at least one of said sensor attachment grooves for detecting the position of said cylinder body with respect to said casing in magnetic coaction with said magnet.

11. A cylinder apparatus according to claim 1, wherein said base plate has a pair of ports defined in an outer wall surface thereof, said compressed-air inlet/outlet ports communicating with said communication passages through said ports, respectively.

12. A cylinder apparatus according to claim 1, further comprising a stopper attached to an end surface of said cylinder body for limiting the reciprocating movement of the cylinder body in the axial directions of said piston.

13. A cylinder apparatus according to claim 4, wherein said base plate and said cylinder body define a first chamber therebetween, and said upper plate and said guide rod define a second chamber therebetween, said base plate having air inlet/outlet holes defined therein for introducing air into and discharging air from said first chamber and said second chamber.

14. A cylinder apparatus comprising:

a base plate;

a piston fixed on top of said base plate and having a piston head and a piston rod connected thereto, wherein an end of said piston rod opposite said piston head is disposed on an upper surface of said base plate;

a cylinder body having a cylinder chamber defined on one side of said piston head and a cylinder chamber defined on another side of the piston head around said piston rod, said cylinder body being supported for reciprocating movement with respect to said base plate in an axial direction of said piston;

a guide rod fixed to said base plate and inserted in said cylinder body for guiding the reciprocating movement of said cylinder body;

an upper plate fixed on top of said cylinder body;

a guide member comprising a casing surrounding said cylinder body and held in slidable contact with an outer circumferential wall surface of said cylinder body for guiding the reciprocating movement of the cylinder body;

a pair of compressed-air inlet/outlet ports defined in a side wall of said casing for introducing a fluid under pressure alternately into said cylinder chambers to reciprocally move said cylinder body and said upper plate with respect to said piston while said cylinder body is being guided by said guide member;

a first pair of communication passages defined in said base plate; and a second pair of communication passages defined in said piston and connected with said first pair of communication passages, wherein said compressed-air inlet/outlet ports communicate with said cylinder chambers through said first and second pairs of communication passages.

15. A cylinder apparatus according to claim 14, wherein said guide member comprises said casing surrounding said cylinder body and a bushing interposed between said casing and said cylinder body and held in slidable contact with the outer circumferential wall surface of said cylinder body.

16. A cylinder apparatus according to claim 14, further comprising locking means for locking said cylinder body against angular displacement with respect to said base plate upon the reciprocating movement of the cylinder body in the axial directions of said piston.

17. A cylinder apparatus according to claim 16, wherein said locking means comprises said guide rod fixed to said base plate, and a hole defined in said cylinder body, said guide rod being inserted in said hole.

18. A cylinder apparatus according to claim 14, wherein said piston is fixed to said base plate at a off-center position with respect to said cylinder body.

19. A cylinder apparatus according to claim 14, further comprising a cushioning member mounted on a surface of said piston for abutment against said cylinder body.

20. A cylinder apparatus according to claim 14, further comprising a cushioning member mounted on a surface of said cylinder body for abutment against said base plate or a surface of said base plate for abutment against said cylinder body.

21. A cylinder apparatus according to claim 19 or 20, wherein said cushioning member comprises an annular damper.

22. A cylinder apparatus according to claim 14, further comprising a magnet disposed on or near the outer circumferential wall surface of said cylinder body.

23. A cylinder apparatus according to claim 22, wherein said casing has a plurality of sensor attachment grooves defined in at least one outer wall surface thereof, and a sensor mounted in at least one of said sensor attachment grooves for detecting the position of said cylinder body with respect to said casing in magnetic coaction with said magnet.

24. A cylinder apparatus according to claim 14, wherein said base plate has a pair of ports defined in an outer wall surface thereof, said compressed-air inlet/outlet ports communicating with said communication passages through said ports, respectively.

25. A cylinder apparatus according to claim 14, further comprising a stopper attached to an end surface of said cylinder body for limiting the reciprocating movement of the cylinder body in the axial directions of said piston.

26. A cylinder apparatus according to claim 17, wherein said base plate and said cylinder body define a first chamber therebetween, and said upper plate and said guide rod define a second chamber therebetween, said base plate having air inlet/outlet holes defined therein for introducing air into and discharging air from said first chamber and said second chamber.

* * * * *